US006024024A

United States Patent [19]

Favaretto

[11] Patent Number: 6,024,024

[45] Date of Patent: Feb. 15, 2000

[54] TABLE STRUCTURE

[76] Inventor: Paolo Favaretto, Via S. Sofia, 74, 35121, Padua, Italy

[21] Appl. No.: 09/164,545

[22] Filed: Oct. 1, 1998

[30] Foreign Application Priority Data

| | | | |
|---|---|---|---|
| Apr. 2, 1998 | [PT] | Portugal | 28433 |
| Apr. 2, 1998 | [PT] | Portugal | 28434 |
| Apr. 2, 1998 | [PT] | Portugal | 28436 |

[51] Int. Cl.[7] ..... A47B 57/00

[52] U.S. Cl. ..... 108/64; 108/50.02; 108/185; 108/158.11; 108/157.1; 403/391; 312/194

[58] Field of Search ..... 108/50.01, 50.02, 108/64, 65, 69, 155, 153.1, 157.1, 157.17, 158.11, 180, 185, 186, 187, 190; 312/194, 195, 223.6; 403/391, 389, 399, 398, 170, 217, 219, 97

[56] References Cited

U.S. PATENT DOCUMENTS

| | | | |
|---|---|---|---|
| 3,175,642 | 3/1965 | Neely | 403/391 X |
| 4,505,609 | 3/1985 | Vella | 403/170 X |
| 4,639,049 | 1/1987 | Frascaroli et al. | 108/64 X |
| 4,748,913 | 6/1988 | Favaretto et al. | 108/64 X |
| 4,848,245 | 7/1989 | Piretti | 403/391 X |
| 5,483,900 | 1/1996 | Elzenbeck | 108/64 |
| 5,522,324 | 6/1996 | Van Gelder et al. | 108/50.02 |
| 5,598,790 | 2/1997 | Fich | 108/158.11 |
| 5,661,942 | 9/1997 | Palmer | 403/97 X |

FOREIGN PATENT DOCUMENTS

| | | | |
|---|---|---|---|
| 3625137 | 10/1987 | Germany | 312/194 |
| 3920285 | 1/1991 | Germany | 312/195 |
| 1217182 | 12/1970 | United Kingdom | 403/391 |

*Primary Examiner*—Peter M. Cuomo
*Assistant Examiner*—Hanh V. Tran
*Attorney, Agent, or Firm*—Flynn, Thiel, Boutell & Tanis, P.C.

[57] ABSTRACT

An enlarged table top is secured to a supporting structure disposed under the top for supportive engagement with a floor. The supporting structure includes a beam which extends longitudinally of the top directly adjacent the underside for fixed securement thereto. The beam is defined by a pair of elongate but sidewardly spaced tubular beam members which are rigidly joined together. An upright leg structure is provided adjacent at least one end of the table and includes a pair of upright but sidewardly spaced leg members having upper ends which are disposed adjacent the ends of the beam elements. A removable bracket includes opposed bracket parts which clamp the leg members therebetween, and one of the bracket parts has cantilevered support rods which telescope into the adjacent ends of the beam members for fixed securement thereto.

17 Claims, 11 Drawing Sheets

TABLE STRUCTURE

FIELD OF THE INVENTION

This invention relates to a table construction for use in an office or similar commercial environment.

BACKGROUND OF THE INVENTION

Numerous freestanding tables exist for use in offices and like environments. Such tables typically employ leg structures disposed adjacent opposite ends of the table and fixed to the underside of the table top. As a variation, some tables employ an undercarriage which extends under and directly engages the table top, and which at opposite ends is rigidly and often times permanently joined to downwardly projecting legs. The undercarriage, however, is often structurally bulky and complex, and is not readily adaptable or suitable for use with different sizes or arrangements of table tops.

This invention relates to a table employing an improved undercarriage or supporting structure for the table top, which supporting structure utilizes simple elements or modules which can be readily assembled to provide a desirably strong and rigid support while still providing desirable aesthetics, and which can be readily adapted for use in conjunction with other cooperating elements to provide modified supporting structures suitable for accommodating a variety of different table top shapes and/or arrangements of adjacent table tops.

In the table of the invention, an enlarged table top is secured to a supporting structure disposed under the top for supportive engagement with a floor. The supporting structure includes a beam which extends longitudinally of the top directly adjacent the underside for fixed securement thereto. The beam is defined by a pair of elongate but sidewardly spaced tubular beam members which are rigidly joined together. An upright leg structure is provided adjacent at least one end of the table and includes a pair of upright but sidewardly spaced leg members having upper ends which are disposed adjacent the ends of the beam elements. A removable bracket includes opposed bracket parts which clamp the leg members therebetween, and one of the bracket parts has cantilevered support rods which telescope into the adjacent ends of the beam members for fixed securement thereto.

Other features and advantages of this invention will be apparent from the following description and the accompanying drawings.

DETAILED DESCRIPTION

Figure 1:
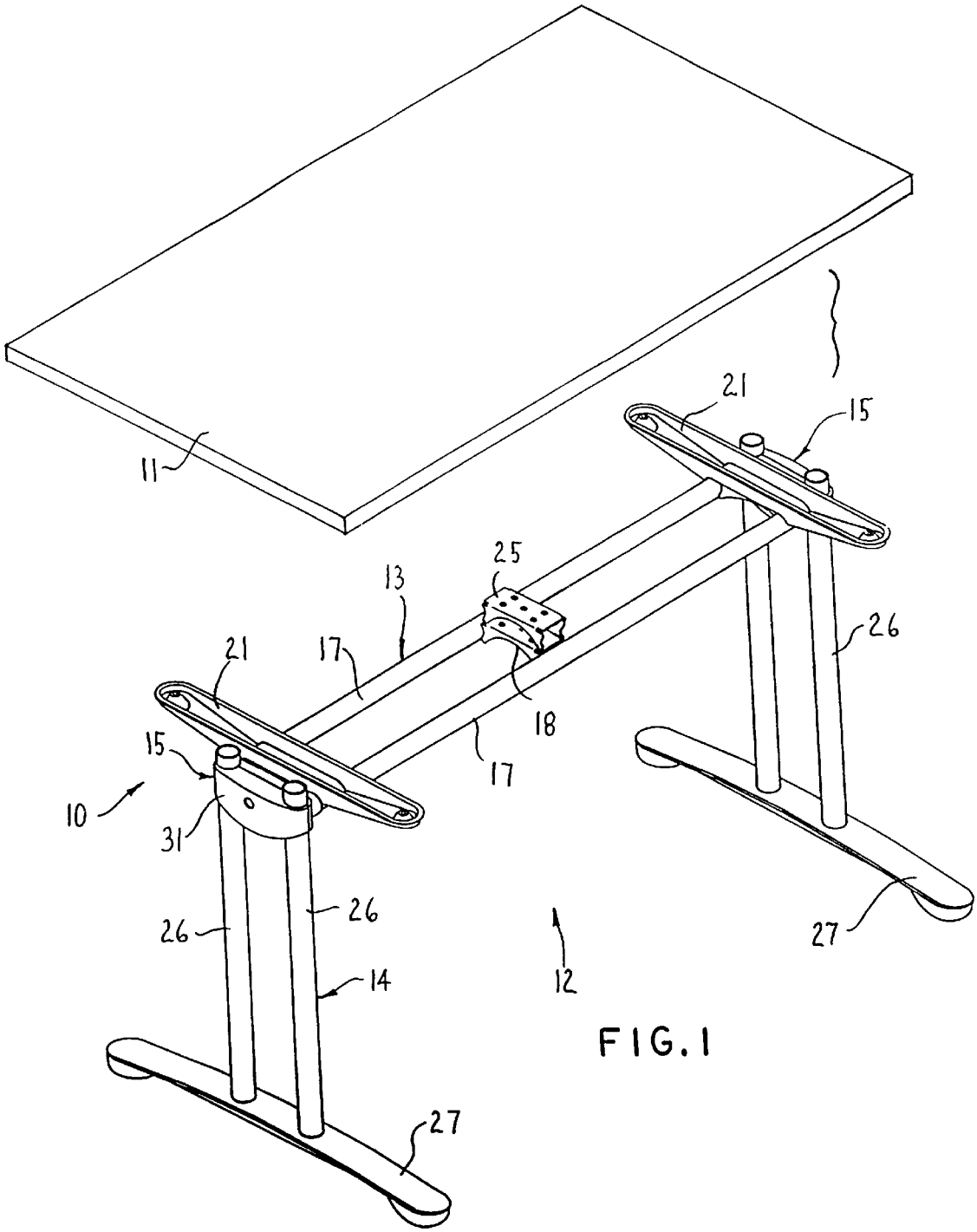
FIG. 1 is a perspective view of a table incorporating the improved supporting structure of this invention.
Figure 2:
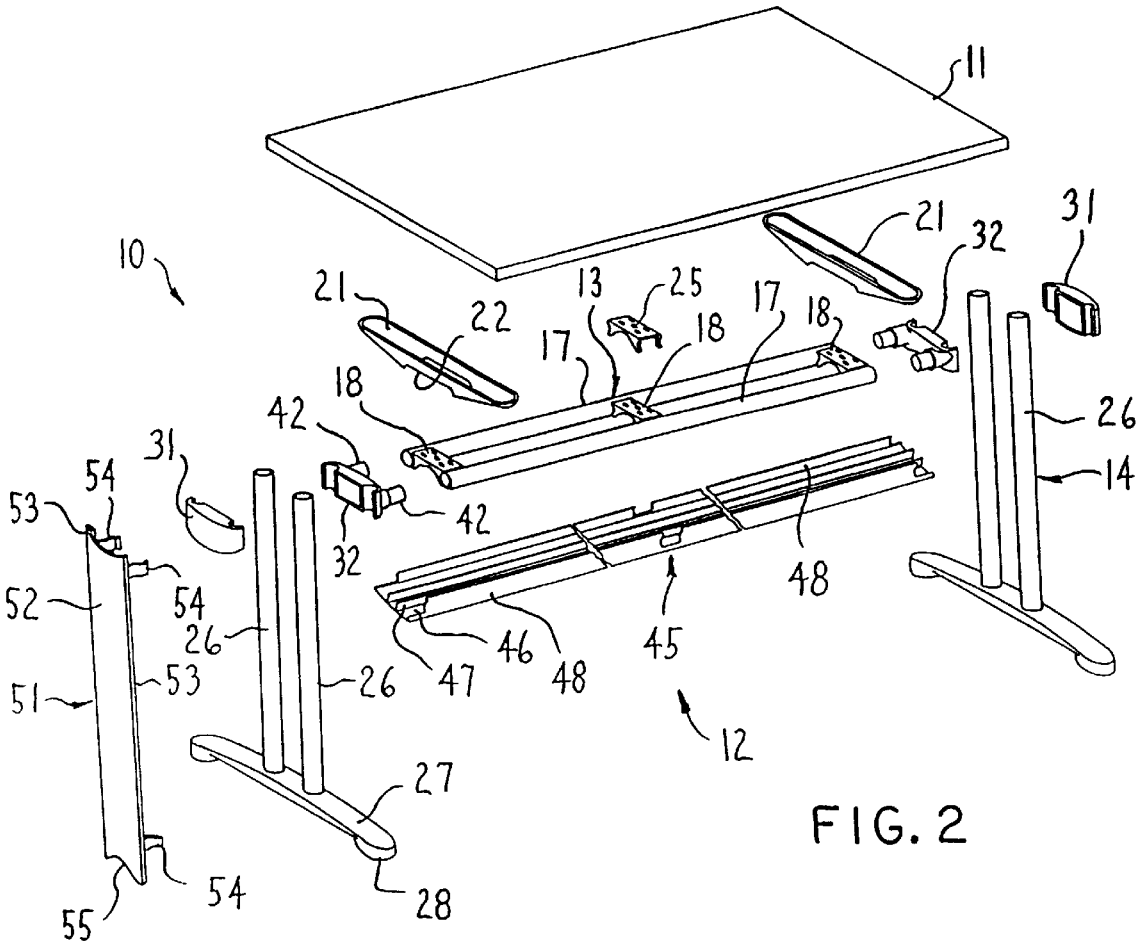
FIG. 2 is a view corresponding to FIG. 1 but showing the supporting structure in an exploded condition, and additionally showing a removable cable trough for the support beam and removable covers for the leg structures.
Figure 3:
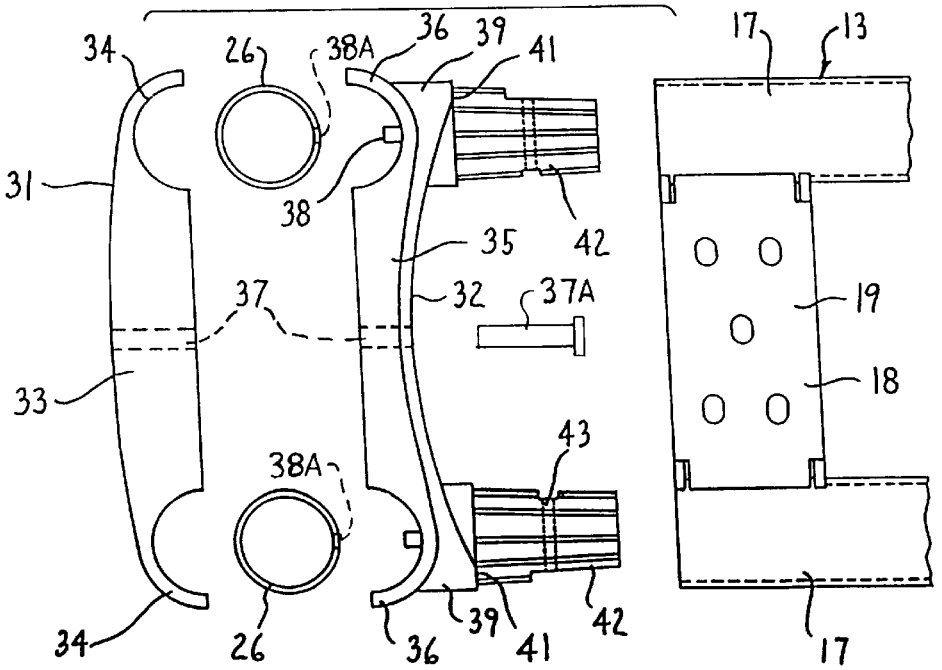
FIG. 3 is an exploded plan view illustrating the upright legs, the supporting beam, and the bracket structure which connects therebetween.

FIGS. 1–3 illustrate a table 10 which represents a first variation of the invention, and which incorporates therein basic components which are incorporated into other variations described hereinafter.

The table 10 includes a generally horizontally enlarged top 11 supported on an undercarriage or supporting structure 12, the latter being supported on a floor. The supporting structure 12 includes a horizontally elongate support beam 13 positioned directly under the top 11 for fixed support therewith. This support beam 13 cooperates with one or more upright leg structures 14 which project downwardly for engagement with the floor. A connecting bracket 15 provides a fixed structural connection between the support beam 13 and the leg structure 14.

The support beam 13 is defined by two horizontally elongate and substantially parallel tubular members 17 disposed in sidewardly spaced relation and rigidly joined by plural channel-like supports 18 extending transversely therebetween. The tubes 17 are preferably circular in cross section, and the supports 18 are provided adjacent opposite free ends of the beam 13, with a further support 18 typically being provided midway along the length of the beam. The support 18 defines a flat upper wall 19 which is substantially flush with the upper profile of the tubes 17. Support 18 has openings therethrough for accommodating fasteners.

The support beam 13 in FIG. 1 has support arms 21 fixed thereto adjacent opposite ends thereof. The support arms 21 are elongated transversely with respect to the tubes 17 and have upper surfaces which engage the bottom surface of the top 11. Fasteners such as screws (not shown) are engaged between the support arms 21 and the top 11. The support arm 21 has a shallow recess 22 formed centrally in the bottom wall thereof, which recess terminates in arcuate ends spaced apart so that the support arm 21 can sit down on top of the support beam 13 with the support beam being positionally closely accommodated within the recess.

Since the support arms 21 project upwardly above the support beam 13, in some situations it may be desirable to provide an additional center support connected between the support beam 13 and the table top 11. While such center support can be defined by a further arm 21 if desired, it can also be accomplished merely by an additional support 25 which is identical to the support 18 and which sits directly on top of the middle support 18, with fasteners such as screws extending upwardly through the supports 18, 25 for engagement with the top 11.

The leg structure 14 includes a pair of generally parallel and vertically elongate upright leg members 26 disposed in sidewardly spaced relation. The legs 26, preferably defined by tubular elements of circular cross section, have their lower ends rigidly joined to a transversely elongated base or foot 27, the latter having glides 28 fixed to the underside for engagement with the floor. The upper ends of leg members 26 terminate at an elevation close to the undersurface of the top 11, and are disposed so as to be spaced horizontally outwardly a small distance from the free ends of the beam tubes 17.

The connecting bracket 15 is defined by outer and inner bracket members 31, 32 which clampingly engage the upper ends of the leg members 26 therebetween. The outer bracket member 31 includes a blocklike center part 33 which extends transversely between the leg members 26, and this center part joins at opposite ends to concave clamping parts 34 which respectively embrace the outer half of the cylindrical profile of the leg members 26 adjacent the upper ends thereof. The inner bracket member 32 is similarly constructed in that it includes a center part 35 which bridges between the leg members 26 and substantially abuts the opposed center part 33 of the outer bracket member. The center part 35 of inner bracket member 32 also has concave clamping parts 36 at opposite ends which are disposed in opposed relationship to the clamping parts 34 on the outer bracket member 31 so as to snugly and fixedly embrace the leg members 26 therebetween. The center parts of the outer and inner bracket members 31, 32 have aligned openings 37 which permit a fastener 37A such as a bolt to extend therebetween to fixedly clamp the bearing parts 31, 32 together. The clamping parts 36 on the inner bracket member 32 are provided with cantilevered securing pins 38 which project radially inwardly from the inner surface thereof. The pins 38 are positioned to project through openings 38A formed in the leg members 26 to provide a fixed positional relationship between the connecting bracket 15 and the leg members 26.

Inner bracket member 32 also has a pair of sidewardly-spaced hubs 39 which project from the outer side of the bearing parts 36. These hubs terminate in annular shoulders 41, with coaxial support rods 42 being cantilevered horizontally outwardly in parallel relationship beyond the shoulders 41. The support rods 42 are sidewardly spaced to align with the beam tubes 17, and are sized so that the support rods 42 can snugly telescope into the free ends of the beam tubes 17 until the latter abut the shoulders 41. The support rods 42 have openings 43 therein which align with transverse openings formed in the tubes 17 to accommodate therein an appropriate fastener element such as a bolt or screw so as to fixedly join the support rod 42 to the respective beam tube 17.

The table 10 can optionally be provided with a removable cable trough 45 (FIG. 2) which resiliently snaps into position on and under the support beam 13. The trough 45 has a length which is slightly shorter than the beam 13, and includes a base wall 46 from which one or more upright ribs 47 project, the latter extending lengthwise of the cable trough. Securing flanges 48 project upwardly from each edge of the base wall 46 and are provided with a curved cross section. The flanges 48 project upwardly a greater extent than the ribs 47 and are resiliently deflected inwardly as the trough is moved upwardly due to the free ends of flanges 48 engaging the inner curved surfaces of the beam tubes 17, whereupon the curvature of the flanges snaps into and generally conforms to the inner semi-cylindrical curvature of the beam tubes 17. When mounted on the beam tubes 17, the flanges 48 and ribs 17 cooperate to define a plurality of channels which extend lengthwise of the table underneath the top 11 for permitting containment of electrical or communication cables.

The table 10 can also be optionally provided with removable covers 51 (FIG. 2) which are intended to releasably resiliently engage the upright leg members 26 so as to enclose the space therebetween. The cover 51 includes an outwardly curved main wall 52 which has a length generally corresponding to the height of the opening between the leg members 26. This main wall 52 terminates in edge parts 53 which extend longitudinally therealong and are adapted to snugly abut the peripheries of the leg members 26. A pair of securing flanges 54 project inwardly from the base wall adjacent opposite ends thereof for creating a resilient engagement with the opposed inner surfaces of legs 26 to resiliently releasably secure the cover to the legs 26. The covers 26 can be positioned adjacent both the outer and inner sides of each leg structure if desired to permit hidden containment of cabling or the like interiorly thereof. The covers 51 can be provided, at the ends thereof, with recesses 55 to facilitate passage of cables from interiorly of the leg structure.

Figure 4:
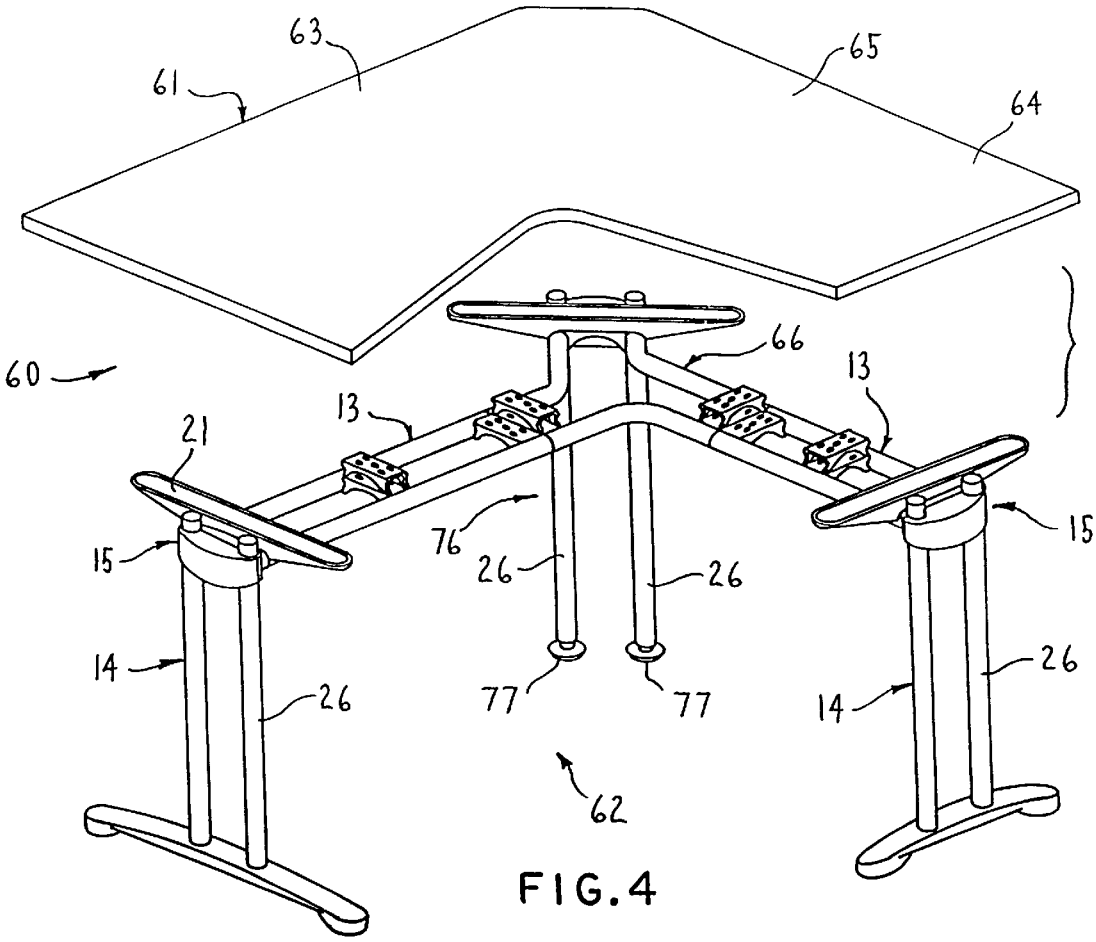
FIG. 4 is a perspective view illustrating a second variation of a table according to the invention.
Figure 5:
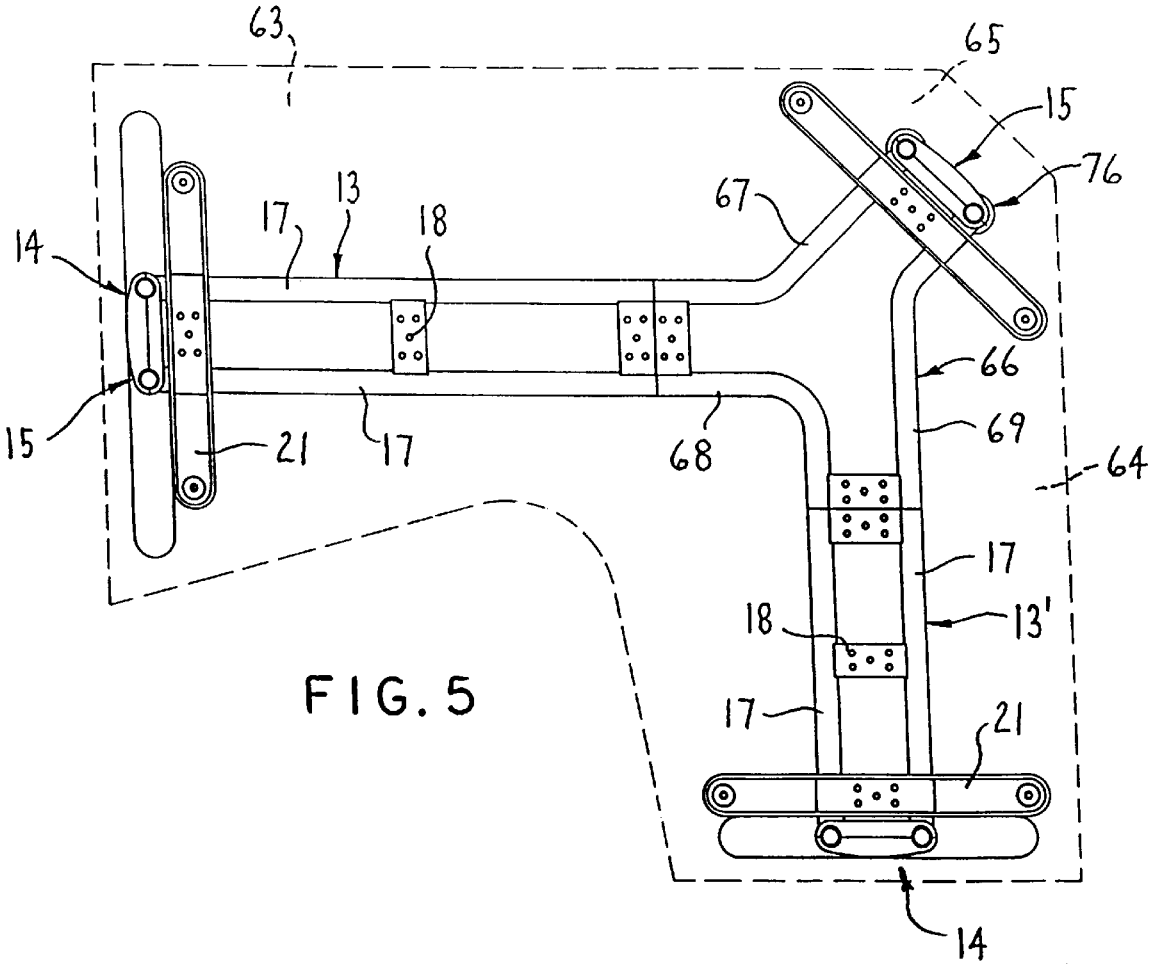
FIG. 5 is a plan view, with the table top removed, of the arrangement of FIG. 4.
Figure 6:
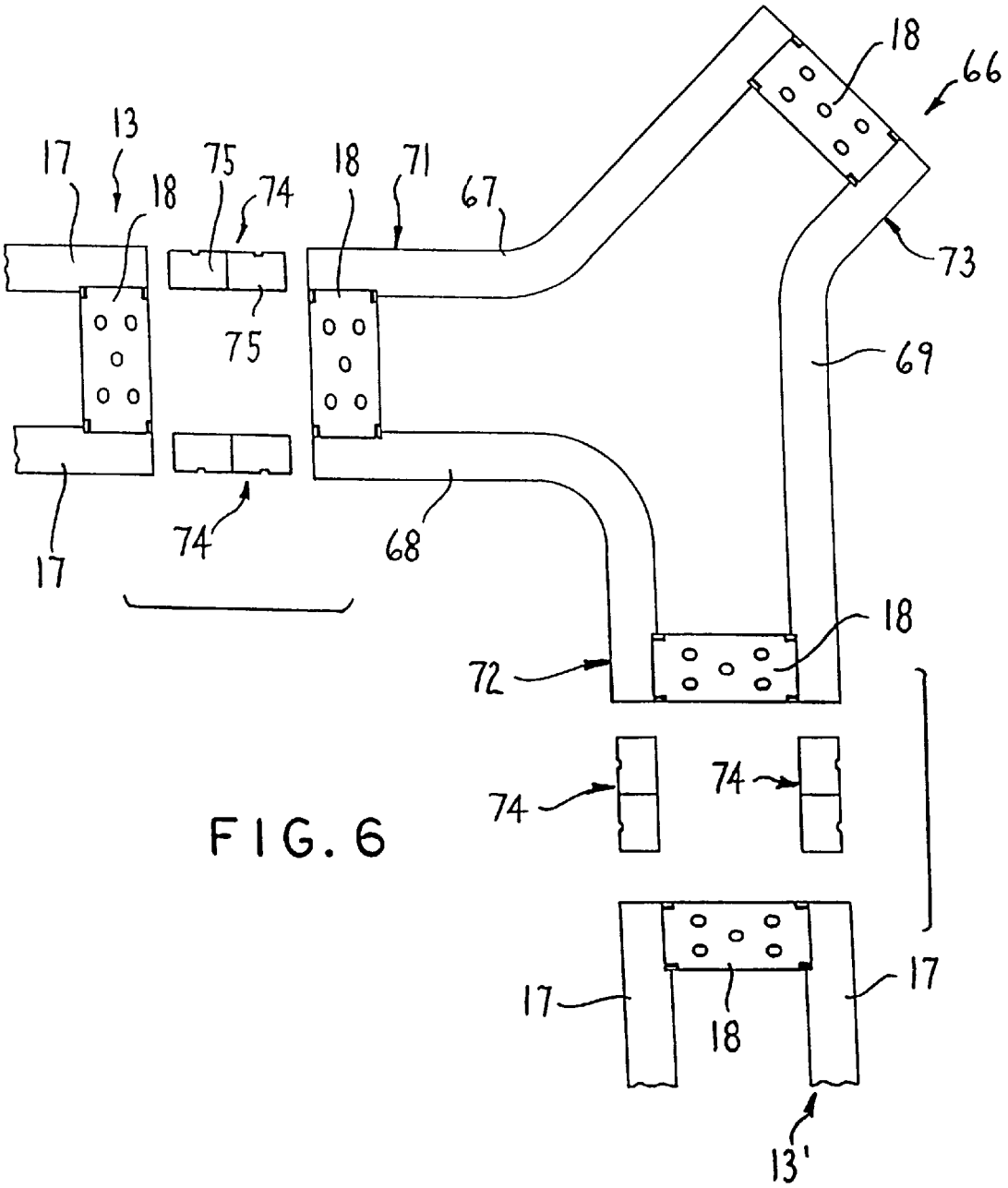
FIG. 6 is a plan view which illustrates the beam connector associated with the beam arrangement of FIG. 5.

FIGS. 4–6 illustrate a table 60 according to a second variation. Table 60 incorporates many of the same components shown in FIGS. 1–3.

The table 60 includes a top 61 supported on an undercarriage or supporting structure 62 which projects upwardly from a floor. The top 61 is generally L-shape and includes enlarged first and second top parts 63, 64 which are joined through a corner part 65.

The support structure 62 includes support beams 13, 13' which are identical but may be of different lengths. The support beam 13 supports top part 63 thereon and connects through bracket 15 to the leg structure 14 provided adjacent a free end of top part 63. The other beam 13' similarly connects at one end thereof to bracket 15 which joins to leg structure 14 provided adjacent the free end of top part 64.

The support beams 13, 13' extend in angled relationship to one another lengthwise of the respective top parts, and are rigidly joined together by a beam connector 66 which is positioned under the corner top part 65. The beam connector 66 is generally Y-shaped and is defined by three elongate tubular elements 67, 68, 69 which correspond in cross section to the beam tubes 17. The tubes 67, 68 have end portions which, as shown in FIG. 6, extend in parallel relationship and define a first leg 71 of the Y beam connector. The tubes 68, 69 similarly have end portions which extend in spaced parallel relationship and define a second leg 72 of the Y beam connector. Lastly, the tubes 67, 69 have end portions which extend in spaced parallel relationship and define a third leg 73 of the Y beam connector.

The tubular elements 67–69 are rigidly joined by channel-like supports 18 which are fixedly secured therebetween adjacent the free end of each leg of the Y.

The leg 71 of beam connector 66 is positioned to abut and align with an adjacent end of beam 13. Opposite cantilevered end parts 75 of rodlike connecting elements 74 are snugly telescoped into the adjacent ends of the aligned tubes 17, 67 and 17, 68 to provide a structural connection therebetween. Fasteners such as bolts or screws secure the connecting elements 74 to the respective tubes.

In similar fashion the tubes defining the leg 72 of connector 66 abut and align with the tubes 17 of beam 13'. Further connectors 74 are snugly telescoped into the aligned ends of the tubes to fixedly connect the beam 13' and the beam connector 66.

The remaining leg 73 of the Y connector projects toward the rear corner of the top part 65, and connects to a further leg structure 76 for supportive engagement with the floor. The leg structure 76 secures to the tubes 67, 69 in the same manner as described above relative to leg structure 14. The leg structure 76, however, can have the lower ends of the leg members 26 provided with separate floor-engaging glides 77 if desired.

FIGS. 7–10 illustrate a table arrangement 80 according to a further variation. The table arrangement 80 involves multiple tops, namely the L-shaped top 61 and a further enlarged top 81 which are disposed so that opposed edges 83 are positioned adjacent one another. The table arrangement includes a supporting structure 82 wherein that portion of the supporting structure associated with the L-shaped top 61 is identical to the supporting structure illustrated in FIGS. 4–5 except that the top 61 is not provided with a leg structure 14 under the free end of the top part 64. Corresponding parts of the table top 61 and the associated supporting structure are accordingly identified by the same reference numerals utilized in FIGS. 4–5.

As to the table top 81, it has a support beam 13" secured thereunder which, adjacent the free end of the table top 81, is joined to a leg structure 14 through a bracket 15. The beam 13" has transverse support arms 21 thereon for engagement with the undersurface of the table top 81.

In table arrangement 80, however, a substantially continuous and rigid beam structure is defined so as to extend under the entirety of the joined tops 61 and 81, and this is accomplished by means of connecting units 85 which rigidly join the opposed adjacent ends of the beams 13' and 13" substantially in the region of the abutting edges 83.

Figure 9:
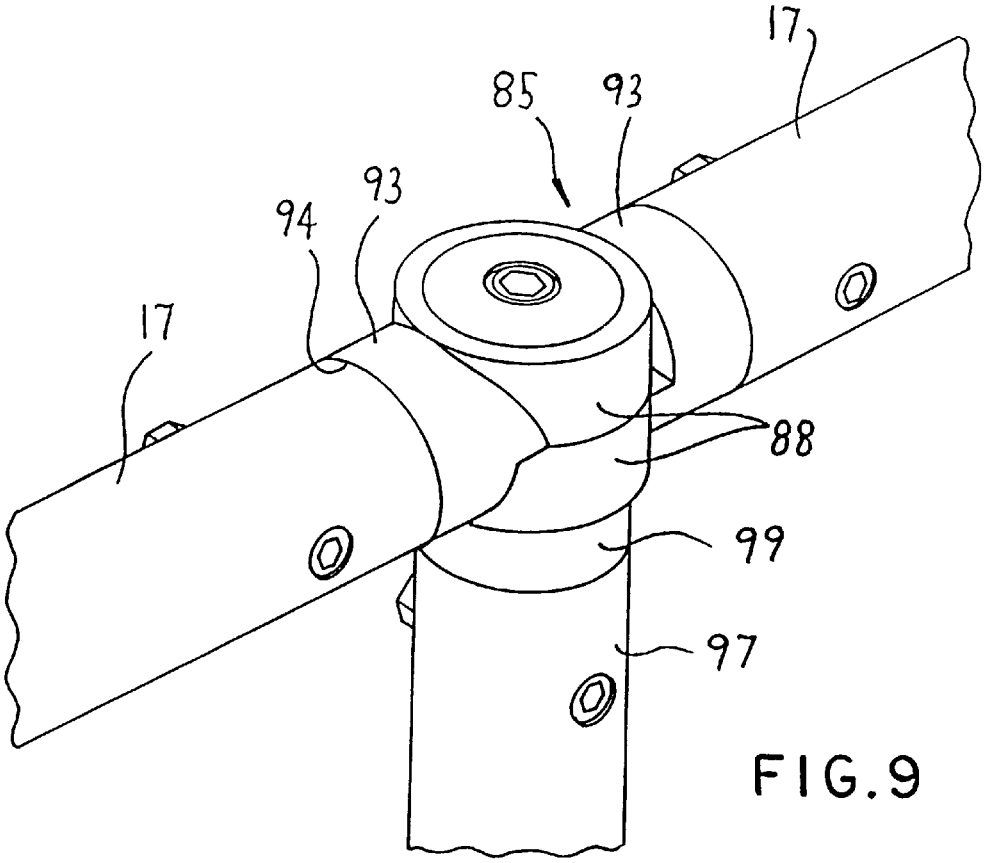
FIG. 9 is an enlarged, fragmentary perspective view illustrating the intermediate leg-connector arrangement utilized in the table of FIGS. 7—8.
Figure 10:
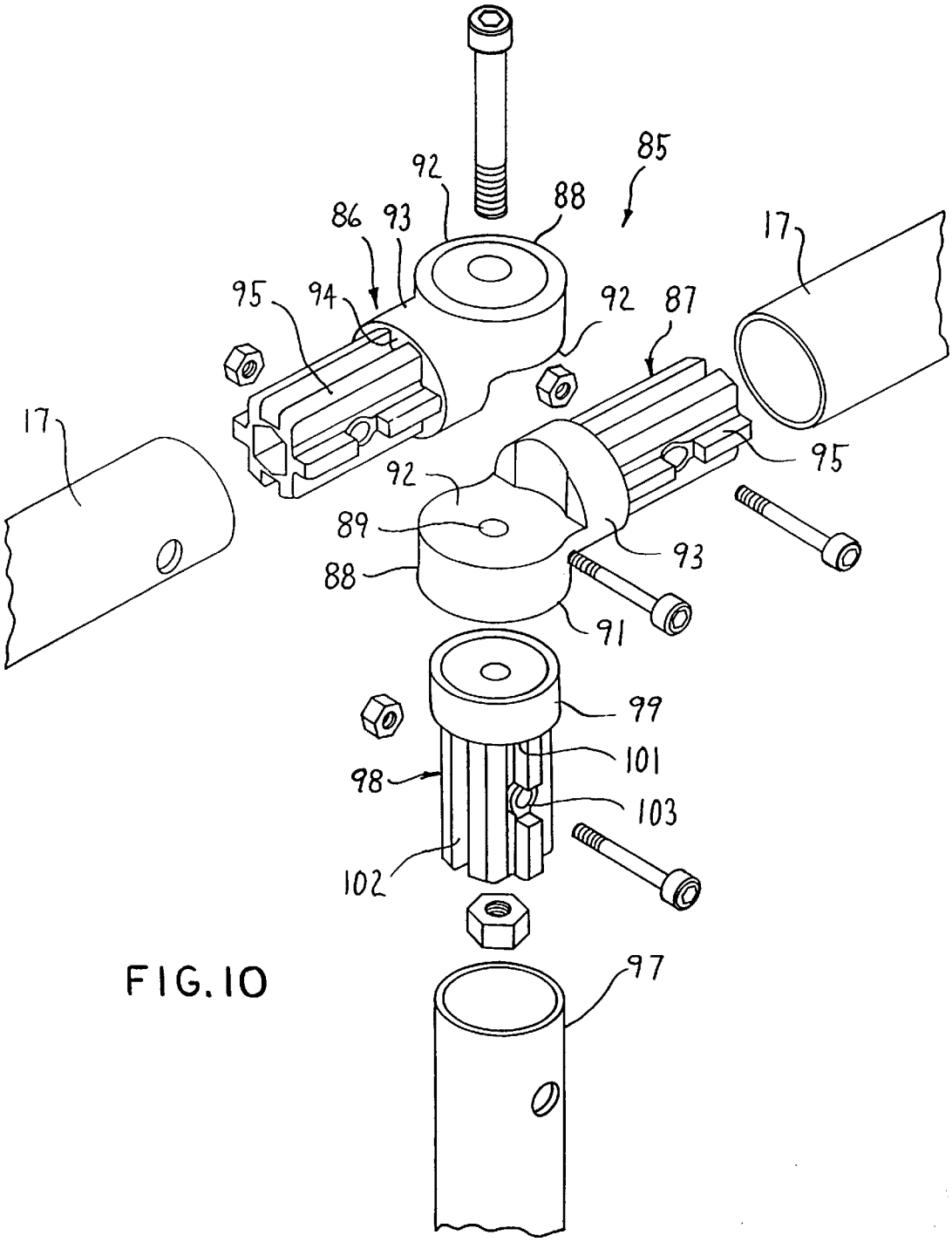
FIG. 10 is an exploded perspective view of the leg-connector arrangement of FIG. 9.

As illustrated in FIGS. 9–10, the connecting unit 85 includes connector parts 86–87 which are substantially identical and each includes at one end a substantially cylindrical hub 88 having an opening 89 projecting vertically coaxially thereof. Each hub 88 is defined between opposite end surfaces 91 and 92, with the end surfaces 92 being defined generally within a horizontal plane which extends generally along a horizontal longitudinally extending axis of a cylindrical hub 93 which is fixed to and projects perpendicularly relative to the cylindrical hub 88. Hub 93 terminates in an annular axially facing shoulder 94, and a further horizontal support rod 95 is cantilevered coaxially outwardly from the shoulder 94. The support rod 95 can be provided with a cross section defined by a plurality of axially extending ribs, with the support rod 93 being sized to snugly telescope into the open end of one of the tubes 17 associated with the beam 13' or 13". The rods 95 of connector parts 86, 87 respectively telescope into the opposed aligned ends of the tubes 17 of the beams 13' and 13", and the cylindrical hubs 88 of the parts 86, 87 are disposed in vertically stacked relation. A fastener such as a bolt is extended through the aligned openings 89 to connect the parts 86, 87 together. The stacking of hubs 88 on top of one another effectively defines a hinge having a vertical axis so that the connector unit 85 can be used to join adjacent support beams which extends in angled relationship to one another.

The connector unit 85 can also be utilized for attachment of a support leg. In the table arrangement of FIGS. 7–8, two connector units 85 are provided so as to permit connection between the aligned pairs of tubes associated with the beams 13, 13", and these connector units mount legs which define a leg structure 96. The leg structure 96 includes a pair of elongate upright legs 97, each of which at its upper end rigidly joins to an intermediate connector part 98 having an upper cylindrical hub 99 which has an upper surface adapted for contact with the opposed lower surface on the hub 88 of the connector part 87. These opposed surfaces can be compatible concave and convex surfaces if desired. The connector part 98 is fixedly secured to the hubs 88 by an elongate fastener which extends through the latter and fixedly connects all of these parts together. This upper hub 98 terminates at a shoulder 101 from which a support rod 102 is coaxially cantilevered downwardly, the latter being sized to snugly telescope into the open upper end of the tubular leg 97 so that the latter abuts the shoulder 101. The support rod 102 has a suitable opening which aligns with an opening in the leg 97 to receive therein an appropriate fastener (i.e. screw or bolt) for creating a fixed connection therebetween.

Figure 7:
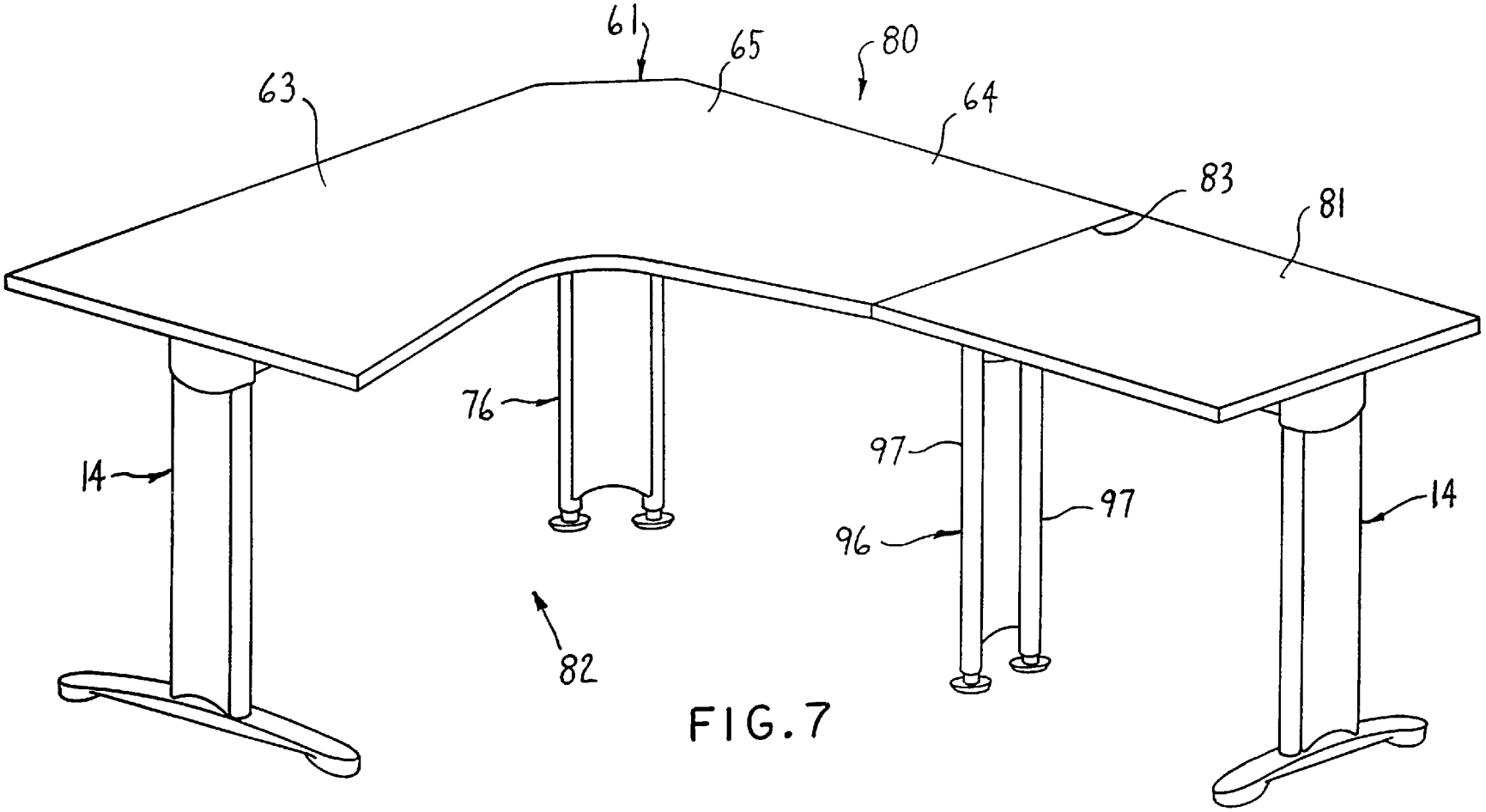
FIG. 7 is a perspective view illustrating a third variation of a table according to the invention.

The leg 96, as illustrated by FIG. 7, is provided with a glide at the lower end for supportive engagement with the floor.

Figure 8:
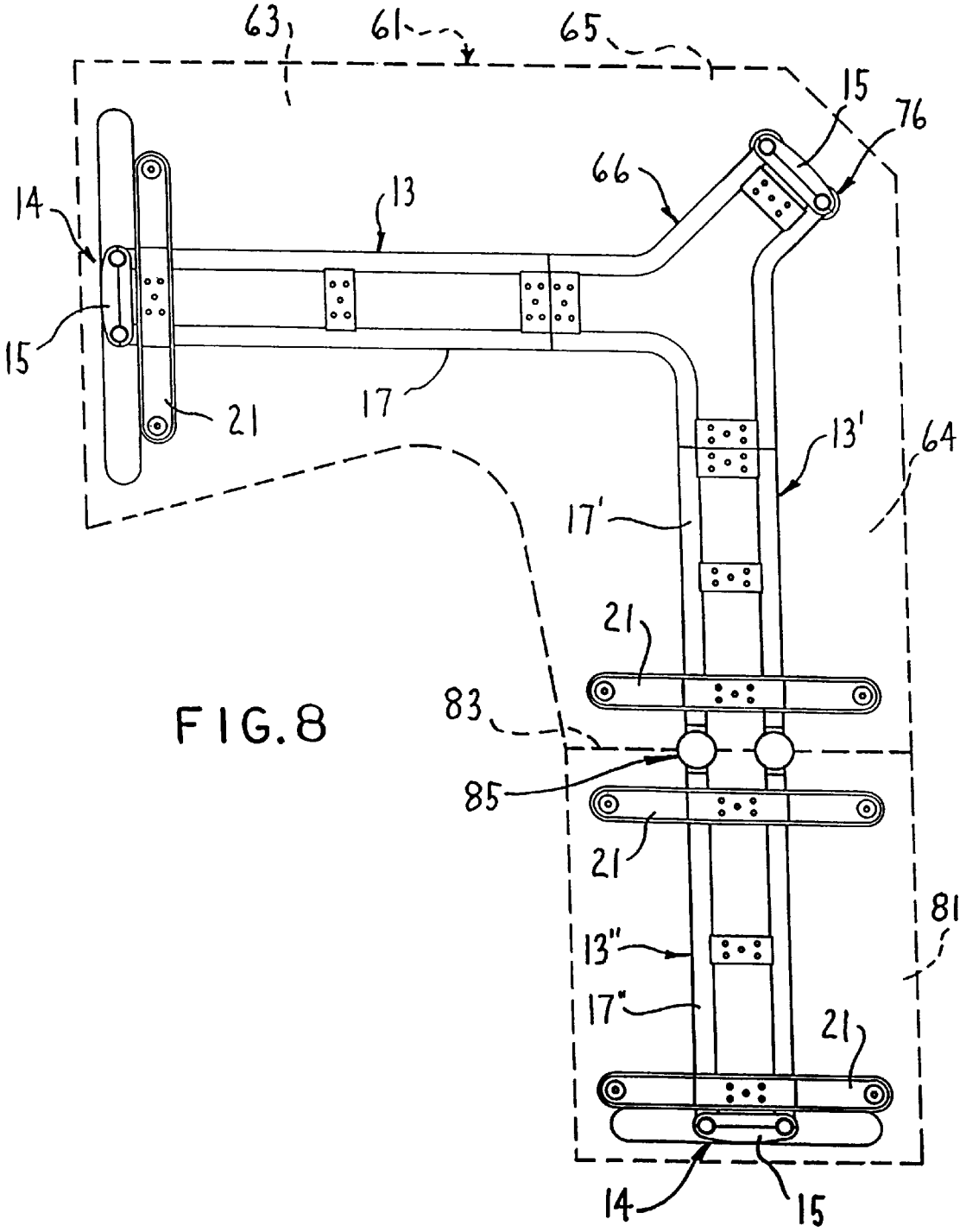
FIG. 8 is a plan view, with the top removed, of the table shown in FIG. 7.

In the arrangement of FIGS. 7–8, the connector units 85 are disposed substantially at the interface between the two table tops to provide a rigid connection of the support beams of the two adjacent table tops. The legs 97 secured to and projecting downwardly from the connector units 85 provide strength and stability at the interface between the two table tops.

Figure 11:
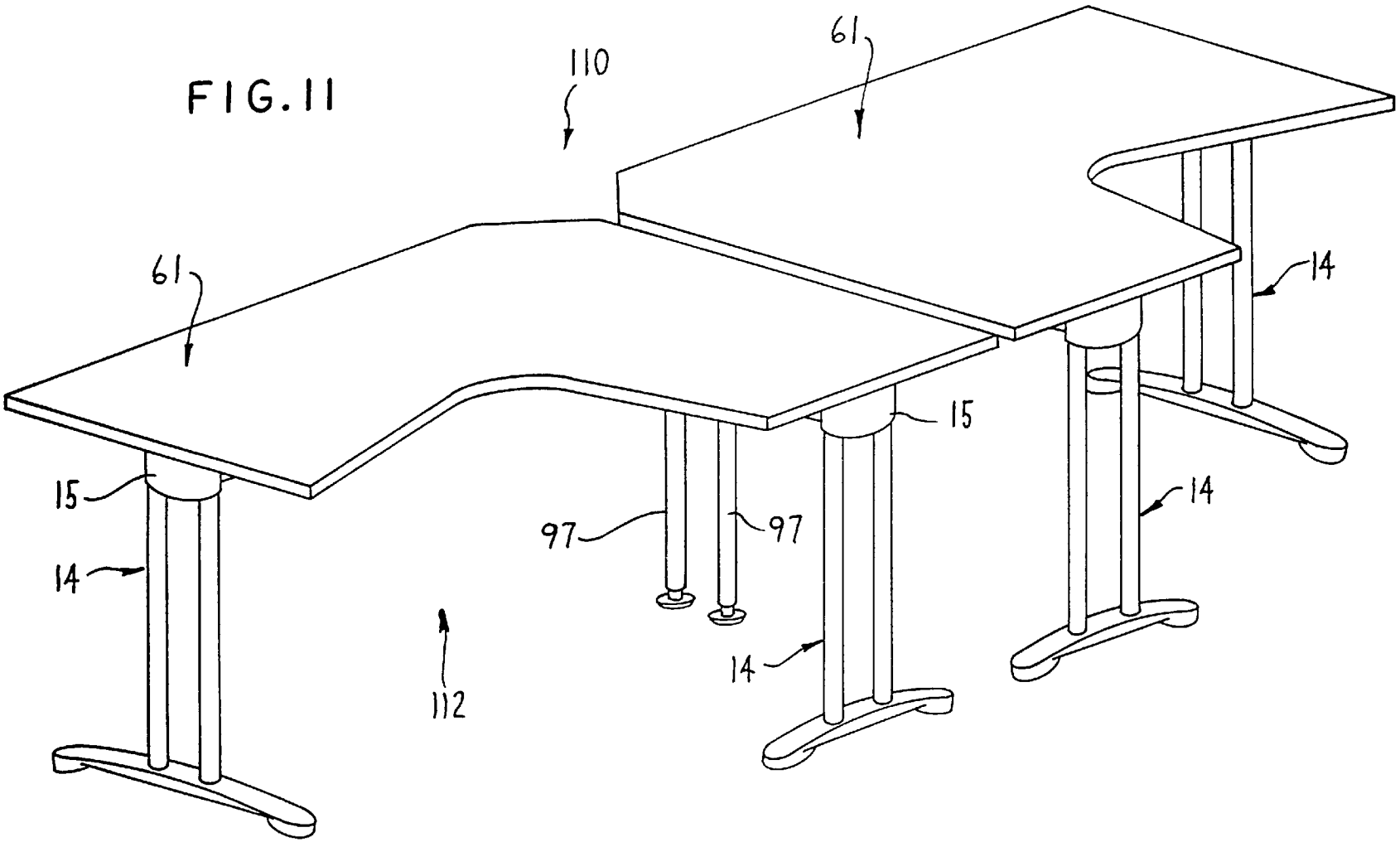
FIG. 11 is a perspective view of a fourth variation of a table according to the invention.
Figure 12:
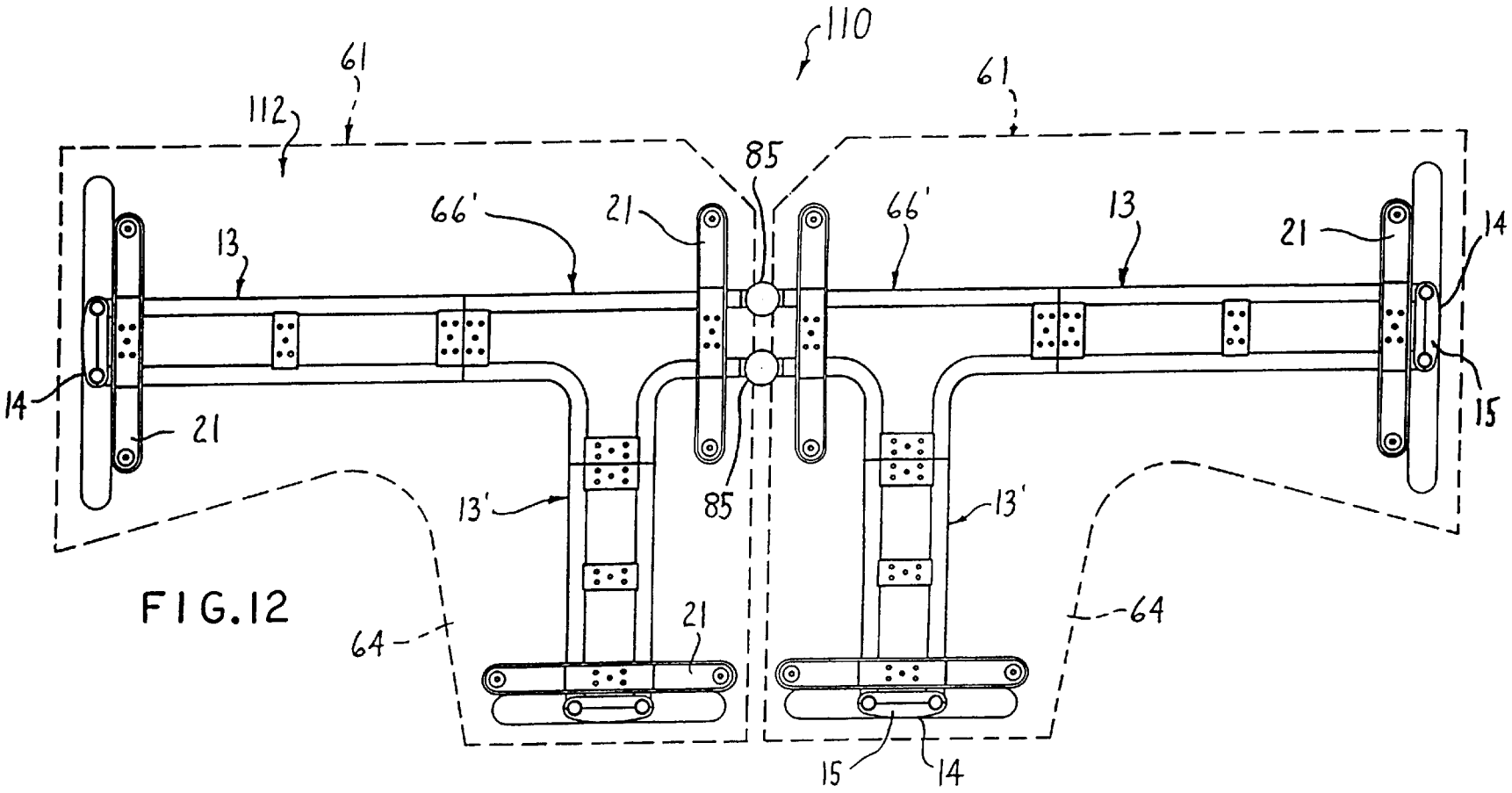
FIG. 12 is a plan view, with the top removed, of the table of FIG. 11.

FIGS. 11–12 illustrate a further variation of a table arrangement 110 according to the invention. The table arrangement 110 is defined by two L-shaped tops 61 supported on a rigid undercarriage or support structure 112 which is positioned under both tops.

The support structure under each top 61 is generally the same as illustrated in FIGS. 4–5 in that each top in FIGS. 11–12 has two support beams 13, 13' provided with leg structures 14 adjacent the free ends thereof, and the two beams 13, 13' under each top 61 are joined by a beam connector 66'. The connector 66' is structurally identical to the Y connector 66 of FIG. 6 except that it is T-shaped.

As illustrated by FIG. 12, side edges of table parts 64 are disposed closely adjacent one another, and the third legs of the T-shaped beam connectors 66' are disposed adjacent one another in opposed aligned relation. The opposed tubes of the two beam connectors 66' are rigidly joined by a pair of connector units 85 which are additionally provided with upright legs 97 secured thereto. This results in a rigid structural beam which extends longitudinally and continuously along the underside of the two table tops, and the legs mounted on the connecting units provide additional stability and supportive strength.

With the table construction described above, numerous table sizes and configurations can be provided, all based on a basic horizontal beam structure which, through use of one or more standardized elongate beams, joined either directly or through appropriate beam connectors or through hinge type connecting units, enables a rather small number of fairly uniform components to be assembled in a wide variety of configurations to thus simplify the overall manufacturing process. Further, the various components are assembled substantially from standard tubular elements secured by appropriate brackets or connections, and the resulting frame structure possesses significant strength and rigidity while being compact, light in weight, and easy to assemble. The overall assembled arrangement also provides a desirable appearance.

It will be recognized that numerous other table configurations, including arrangements having multiple tops, can be constructed utilizing the basic modules and construction techniques illustrated and described herein.

What is claimed is:

1. A table having a horizontally enlarged top disposed over and mounted on a supporting structure, the supporting structure comprising a horizontally elongate support beam disposed closely adjacent a bottom surface of the top and extending generally in a lengthwise direction of the top, the support beam including a pair of horizontally elongated tubular beam members disposed in parallel but sidewardly spaced relation and rigidly joined together by first and second support members which extend transversely between the tubular beam members adjacent opposite ends thereof, at least one upright support leg having a lower end engaged with the floor and projecting upwardly for securement to one end of the support beam, members said support leg including a pair of vertically elongate leg members disposed in parallel but sidewardly spaced relation and terminating in upper ends which are disposed adjacent but spaced outwardly from ends of the beam members, and a removable bracket structure for fixedly attaching said leg members to the adjacent ends of the beam members, said bracket structure including first and second bracket members which transversely extend between said leg members and are respectively disposed adjacent outer and inner sides of the support leg, said first and second bracket members having opposed clamping parts adjacent opposite ends thereof for clamping the leg members therebetween in the vicinity of the upper ends thereof, and said second bracket member having a pair of sidewardly-spaced rodlike projections extending in parallel and cantilevered relation therefrom, said projections being telescoped into the ends of the beam members and fixedly secured thereto.

2. A table according to claim 1, wherein the leg members are hollow tubular members of circular cross section substantially the same as the circular cross section of the beam members, the opposed clamping parts being substantially semi-cylindrical so that the leg members are snugly embraced therebetween, the clamping parts having projections which project inwardly for engagement within openings in the leg members, and a removable fastener extending between the bracket members to fixedly secure the bracket members together in embracing relation to the leg members.

3. A table according to claim 2, including a horizontally elongated cable trough of generally upwardly-opening channel-like shape, said cable trough having upwardly projecting resilient flanges which resiliently engage the beam members so that the cable trough is positioned directly under and extends lengthwise of the support beam.

4. A table according to claim 1, wherein the top includes first and second horizontally enlarged top parts which extend in angled relationship relative to one another, first and second said support beams fixedly secured under the respective first and second top parts and extending in lengthwise directions thereof so that said first and second support beams extend at a horizontal angle with respect to one another, first and second said support legs respectively joined to outer ends of said first and second support beams by a said bracket structure, a beam connector positioned directly under said top and fixedly connected between inner ends of said first and second support beams, said beam connecting being defined by three tubular elements defining a Y- or T-shaped configuration with each leg of the Y- or T-shaped configuration being defined by two of said tubular elements being disposed in parallel but horizontally sidewardly spaced relation and terminating in a free end, the tubular elements defining one leg of the beam connector being disposed closely adjacent and aligned with and fixedly connected to the tubular beam elements at the inner end of said first support beam, the tubular elements defining a second leg of the beam connector being disposed closely adjacent and aligned with and fixedly connected to the tubular beam members defined at the inner end of the second support beam, and a third leg structure being connected to the tubular elements defining a third leg of the beam connector, said third leg structure including a pair of generally parallel and elongate vertical leg elements disposed in sidewardly spaced relation, and a connecting structure for securing the upper ends of the leg elements to the free ends of the tubular elements defining the third leg, said connecting structure including a pair of parallel and sidewardly spaced and horizontally cantilevered projections which extend transversely from the respective leg elements and are snugly telescoped into and fixedly secured to the tubular elements defining the third leg of the beam connector.

5. A table according to claim 4, wherein said connecting structure is defined by said bracket structure.

6. A table according to claim 4, wherein said connecting structure is defined by two identical connector members each having a said horizontally cantilevered projection which at one end terminates in a vertically oriented hub, the hubs of the two connector members being vertically stacked and joined together by a fastener extending vertically therethrough so that the respective horizontally cantilevered projections can be telescoped into and fixedly engaged with the tubular beam members of two adjacent support beams or beam connectors, and the leg element of said third leg structure being fixed to and projecting vertically downwardly in alignment with said hubs.

7. A table according to claim 4, wherein the leg members are hollow tubular members of circular cross section substantially the same as the circular cross section of the beam members, the opposed clamping parts being substantially semi-cylindrical so that the leg members are snugly embraced therebetween, the clamping parts having projections which project inwardly for engagement within openings in the leg members, and a removable fastener extending between the bracket members to fixedly secure the bracket members together in embracing relation to the leg members.

8. A table according to claim 1, wherein the top includes at least first and second horizontally enlarged top parts, the support beam comprising first and second horizontally elongated support beam parts which are disposed closely adjacent and fixedly secured to a bottom surface of the first and second top parts respectively, each said support beam part being defined by said horizontally elongated tubular beam members, and a connector unit for releasably but rigidly connecting a first said tubular beam member of said first support beam part to a first said tubular beam member of said second support beam part, said connector unit including substantially identical first and second connecting parts each defined by a substantially vertically-oriented support hub fixedly and permanently joined to a horizontally cantilevered rodlike projection which is offset vertically from the respective support hub so that a longitudinally-extending centerline of said rodlike projection is approximately aligned with an end surface of said support hub, said first and second connecting parts being disposed so that the rodlike projections thereof are telescoped and fixedly secured into an adjacent end of the first beam members of the first and second support beam parts respectively, and the support hubs of the first and second connector parts are vertically stacked one on top of the other and joined by a connector extending vertically therebetween.

9. A table according to claim 8, wherein the top includes a third horizontally enlarged top part having a third support beam part fixedly secured thereunder and defined by said horizontally elongated tubular beam members, and a second connector unit for rigidly but releasably joining a second said tubular beam member of said second support beam part to a first said tubular beam member of said third support beam part, said second connector unit being identical to first said connector unit.

10. A table according to claim 9, wherein a vertically elongate leg member is coaxially fixed to and projects vertically downwardly from the vertically stacked hubs of said second connector unit for engagement with the floor.

11. A table according to claim 8, wherein a vertically elongate leg member is coaxially fixed to and projects vertically downwardly from the vertically stacked hubs of said connector unit for engagement with the floor.

12. A table according to claim 1, wherein the top includes first, second and third horizontally enlarged top parts, said first and second top parts extend in angled relationship relative to one another; first, second and third said support beams fixedly secured under the respective first, second and third top parts and extending in lengthwise directions thereof so that said first and second support beams extend at a horizontal angle with respect to one another, said third support beam extends generally aligned with said second support beam; first and second said support legs respectively joined to outer ends of said first and third support beams by a respective said bracket structure, said outer end of said second support beam being adjacent an inner end of said third support beam; a beam connector positioned directly under said top and fixedly connected between inner ends of said first and second support beams, said beam connector being defined by three tubular elements defining a Y- or T-shaped configuration with each leg of the Y- or T-shaped configuration being defined by two of said tubular elements being disposed in partly parallel but horizontally sidewardly spaced relation and terminating in a free end, the tubular elements defining a first leg of the beam connector being disposed closely adjacent and aligned with and fixedly connected to the tubular elements at the inner end of said first support beam, the tubular elements defining a second leg of the beam connector being disposed closely adjacent and aligned with and fixedly connected to the tubular elements at the inner end of said second support beam, the tubular elements defining a third leg of the beam connector being fixedly connected together by a said bracket structure and a third said support leg joined thereto, a leg structure being connected to both said second and third support beams and including a pair of generally parallel and elongate vertical leg elements disposed in a sidewardly spaced relation, and a connecting structure for joining said beam members of said second and third support beams together, said connecting structure including a pair of parallel and sidewardly spaced and horizontally cantilevered projections which extend transversely from the respective leg elements and are snugly telescoped into and fixedly secured to the beam members of said second and third support beams.

13. A table according to claim 12, wherein said connecting structure is defined by said bracket structure.

14. A table according to claim 12, wherein said connecting structure is defined by two identical connector members each having a said horizontally cantilevered projection which at one end terminates in a vertically oriented hub, the hubs of the two connector members being vertically stacked and joined together by a fastener extending vertically therethrough so that the respective horizontally cantilevered projections can be telescoped into and fixedly engaged with the tubular beam members of two adjacent support beams, and the leg element of said fourth leg structure being fixed to and projecting vertically downwardly in alignment with said hubs.

15. A table according to claim 12, wherein the leg members are hollow tubular members of circular cross section substantially the same as the circular cross section of the beam members, the opposed clamping parts being substantially semi-cylindrical so that the leg members are snugly embraced therebetween, the clamping parts having projections which project inwardly for engagement within openings in the leg members, and a removable fastener extending between the bracket members to fixedly secure the bracket members together in embracing relation to the leg members.

16. A table according to claim 1, wherein the top includes first and second horizontally enlarged top parts which extend in angled relationship relative to one another, first and second said support beams fixedly secured under the respective first and second top parts and extending in lengthwise directions thereof so that said first and second support beams extend at a horizontal angle with respect to one another, first and second said support legs respectively joined to outer ends of said first and second support beams by a said bracket structure, a beam connector positioned directly under said top and fixedly connected between inner ends of said first and second support beams, said beam connector being defined by three tubular elements defining a Y- or T-shaped configuration with each leg of the Y- or T-shaped configuration being defined by two of said tubular elements being disposed in parallel but horizontally sidewardly spaced relation and terminating in a free end, the tubular elements defining one leg of the beam connector being disposed closely adjacent and aligned with and fixedly connected to the tubular elements at the inner end of said first support beam, the tubular elements defining a second leg of the beam connector being disposed closely adjacent and aligned with and fixedly connected to the tubular beam members defined at the inner end of the second support beam, and a third said support leg being connected to the tubular elements defining a third leg of the beam connector, said third leg structure including a pair of generally parallel and elongate vertical leg elements disposed in sidewardly spaced relation, said legs being fixed to said third leg of said beam connector by a said bracket structure.

17. A table having a horizontally enlarged top disposed over and mounted on a supporting structure, the supporting structure comprising a horizontally elongate support beam disposed closely adjacent a bottom surface of the top and extending generally in a lengthwise direction of the top, the support beam including a pair of horizontally elongated tubular beam members disposed in parallel but sidewardly spaced relation and rigidly joined together by support members which extend transversely between the tubular beam members, at least one upright support leg having a lower end engaged with the floor and projecting upwardly for securement to one end of the support beam, said support leg including a pair of vertically elongate leg members disposed in sidewardly spaced relation and terminating in upper ends which are disposed adjacent but spaced outwardly from ends of the beam members, and a removable bracket structure for fixedly attaching said leg members to the adjacent ends of the beam members, said bracket structure including first and second bracket members which transversely extend between said leg members and are respectively disposed adjacent outer and inner sides of the leg structure, said first and second bracket members having opposed clamping parts adjacent opposite ends thereof for clamping the leg members therebetween in the vicinity of the upper ends thereof, and said second bracket member having a rodlike projection extending in cantilevered relation therefrom, said projection being telescoped into one end of said support beam and fixedly secured thereto.

* * * * *

UNITED STATES PATENT AND TRADEMARK OFFICE

CERTIFICATE OF CORRECTION

PATENT NO. : 6,024,024
DATED : February 15, 2000
INVENTOR(S) : Paolo Favaretto

It is certified that error appears in the above-identified patent and that said Letters Patent is hereby corrected as shown below:

Column 7,
Line 10, change “beam, members” to -- beam members --.
Line 54, change “connecting” to -- connector --.

Signed and Sealed this

Twenty-first Day of January, 2003

JAMES E. ROGAN
*Director of the United States Patent and Trademark Office*